United States Patent [19]

Stoll et al.

[11] Patent Number: 4,805,724

[45] Date of Patent: Feb. 21, 1989

[54] SOUND-ABSORBING PANEL

[75] Inventors: Werner Stoll; Edgar Weiss, both of Neckarsteinach, Fed. Rep. of Germany

[73] Assignee: Odenwald-Chemie GmbH, Schönau, Fed. Rep. of Germany

[21] Appl. No.: 49,661

[22] Filed: May 13, 1987

[30] Foreign Application Priority Data

May 13, 1986 [DE] Fed. Rep. of Germany ... 8613009[U]

[51] Int. Cl.[4] ..... E04B 1/82

[52] U.S. Cl. ..... 181/290; 181/291; 181/294

[58] Field of Search ..... 181/284, 287, 291, 294, 181/286, 201, DIG. 1, 290

[56] References Cited

U.S. PATENT DOCUMENTS 3,480,104 11/1969 Austin et al. ..... 181/291 X
3,542,638 11/1970 Kenny ..... 181/201 X
4,097,633 6/1978 Focht ..... 181/294 X
4,253,543 3/1981 Johansson ..... 181/291 X
4,283,457 8/1981 Kolsky et al. ..... 181/294 X
4,553,631 11/1985 Panza ..... 181/286 X

FOREIGN PATENT DOCUMENTS 963632 7/1964 United Kingdom ..... 181/291

*Primary Examiner*—B. R. Fuller

*Attorney, Agent, or Firm*—Herbert L. Lerner; Laurence A. Greenberg

[57] ABSTRACT

A sound-absorbing panel includes a synthetic foam mat having a given size, a synthetic fiber web having substantially the given size, a first attachment for attaching the synthetic foam mat to the synthetic fiber web at least pointwise, and a second attachment for attaching the sound-absorbing panel to a wall for damping sound radiation of the wall while maintaining a distance between the sound-absorbing panel and the wall.

16 Claims, 2 Drawing Sheets

SOUND-ABSORBING PANEL

Figure 1:
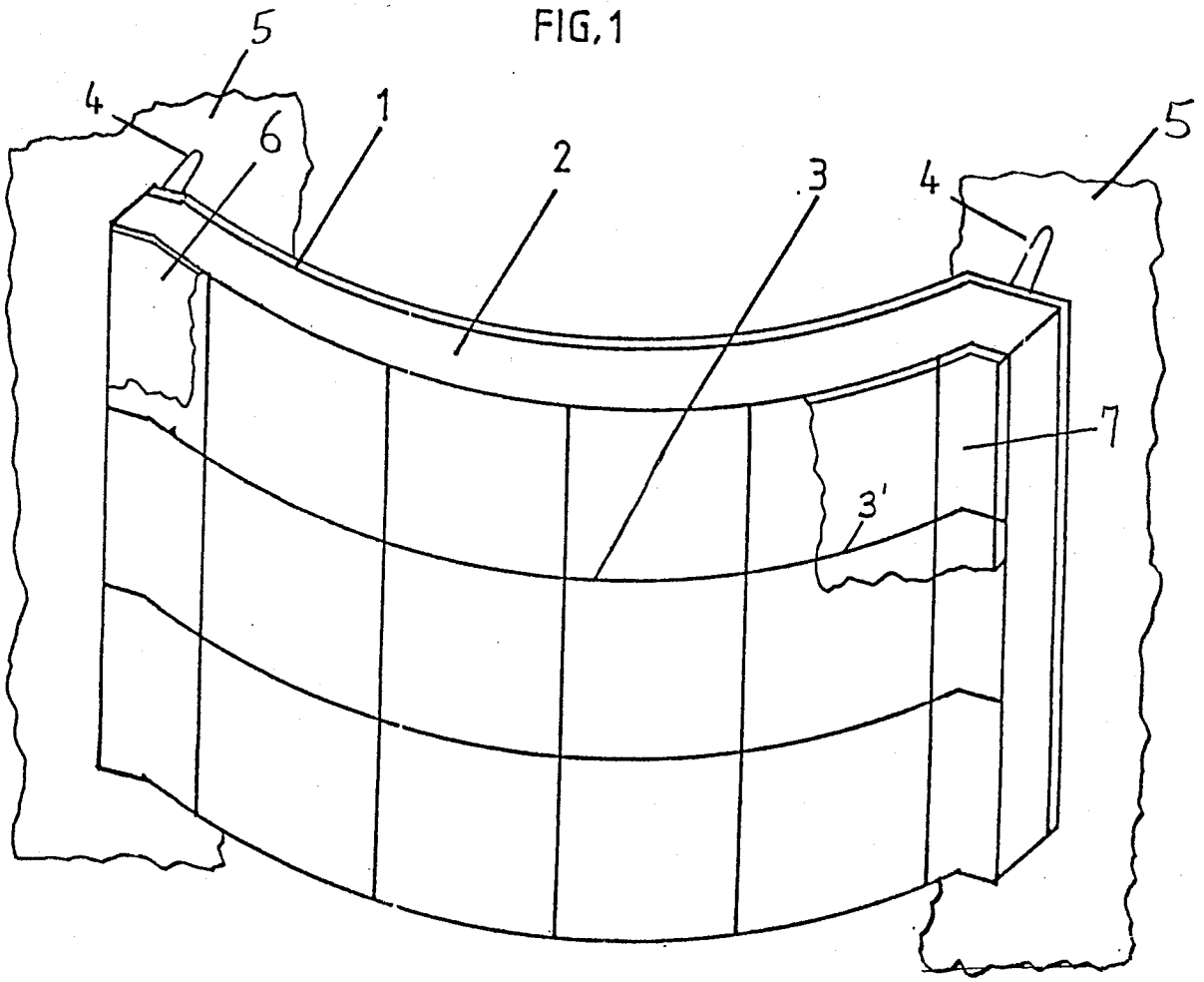

The invention relates to a sound-absorbing panel made of a synthetic foam mat.

Sound-absorbing panels either serve to damp the vibrations of an area, such as a membrane or a wall, so that the sound radiation from the area is drastically reduced, or to protect the area from the impact of sound waves, thus avoiding a reflection of sound. The latter use of sound-absorbing panels is mainly considered herein.

The degree of sound reflection of such sound-absorbing panels thus must be nearly zero, i.e. the sound-absorbing panel must almost completely absorb the sound waves impacting on it. It is known to use plastic foam mats for this purpose which are glued to the area the sound reflection of which is to be reduced However, the degree of sound absorption of such mats is unsatisfactory, especially when the area to be damped is a sheet metal wall such as, for example, the engine compartment of motor vehicles. Experience has shown that such sheet metal walls can easily be caused to vibrate. Their natural frequency often lies in the area of vibration frequencies generated or transferred by the engine. Mats made of a textile fiber web or pressed synthetic fiber web are either too thin or too heavy and are therefore only usable in a relatively narrow frequency band.

Plastic foam panels alone, with or without a skin, are not suitable for sound absorption unless they are so thick that they can no longer be easily worked or so thick that they take up much too much space, which normally is not available.

It is accordingly an object of the invention to provide a sound-absorbing panel which overcomes the hereinafore-mentioned disadvantages of the heretofore-known devices of this general type, in such a way that they per se have a high degree of sound absorption, that they can be installed in front of the sound-reflecting areas in such a way that a transfer of the sound waves to these areas is almost completely avoided and that they require little space.

With the foregoing and other objects in view there is provided, in accordance with the invention, a sound-absorbing panel, comprising a synthetic foam mat having a given size, a synthetic fiber web having substantially the given size, first means for attaching the synthetic foam mat to the synthetic fiber web at least pointwise, and second means for attaching the sound-absorbing panel to a wall for damping sound radiation of the wall while maintaining a distance between the sound-absorbing panel and the wall.

A combination of a synthetic fiber web with a synthetic foam mat added thereto creates a sound-absorbing panel which can be permanently formed into any desired shape by thermal deformation of the synthetic fiber web. It is especially because of this feature that it is possible to give to the sound-absorbing panel exactly the shape of that area or wall which is to be protected from the impact of sound waves. The installation of the sound-absorbing panel at a distance from the wall to be protected prevents a direct transfer of the sound from the body of the panel to the body of the wall, which adds significantly to sound absorption.

In accordance with another feature of the invention, the first attaching means are in the form of a riveted seam, a sewn seam or a welded seam.

In accordance with a further feature of the invention, the second attaching means are in the form of spacers.

In accordance with an added feature of the invention, the first attaching means attach the synthetic fiber web to the synthetic foam mat along given lines, preferably in accordance with a square pattern.

In accordance with an additional feature of the invention, there is provided a liquid synthetic material sprayed on the synthetic foam mat forming a continuous, water-repellent skin.

In accordance with yet another feature of the invention, the synthetic skin is a polyurethane skin.

In accordance with yet a further feature of the invention, there is provided a water-proof nylon web covering the synthetic foam mat, and third means for connecting the water-proof nylon web to the synthetic foam mat at least pointwise.

In accordance with yet an added feature of the invention, the synthetic foam mat is formed of a material from the group consisting of polyurethane foam, melamine foam and polyamide foam.

In accordance with yet an additional feature of the invention, the synthetic foam mat is formed of a material from the group consisting of glass wool and synthetic wool.

In accordance with still another feature of the invention, the synthetic fiber web is formed of permanently deformable material.

In accordance with still a further feature of the invention, the synthetic fiber web is formed of polyester.

In accordance with a concomitant feature of the invention, the distance between the synthetic fiber web and the wall is substantially between 20 and 30 mm, which has proven effective and is preferred.

Other features which are considered as characteristic for the invention are set forth in the appended claims.

Although the invention is illustrated and described herein as embodied in a sound-absorbing panel, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 2:
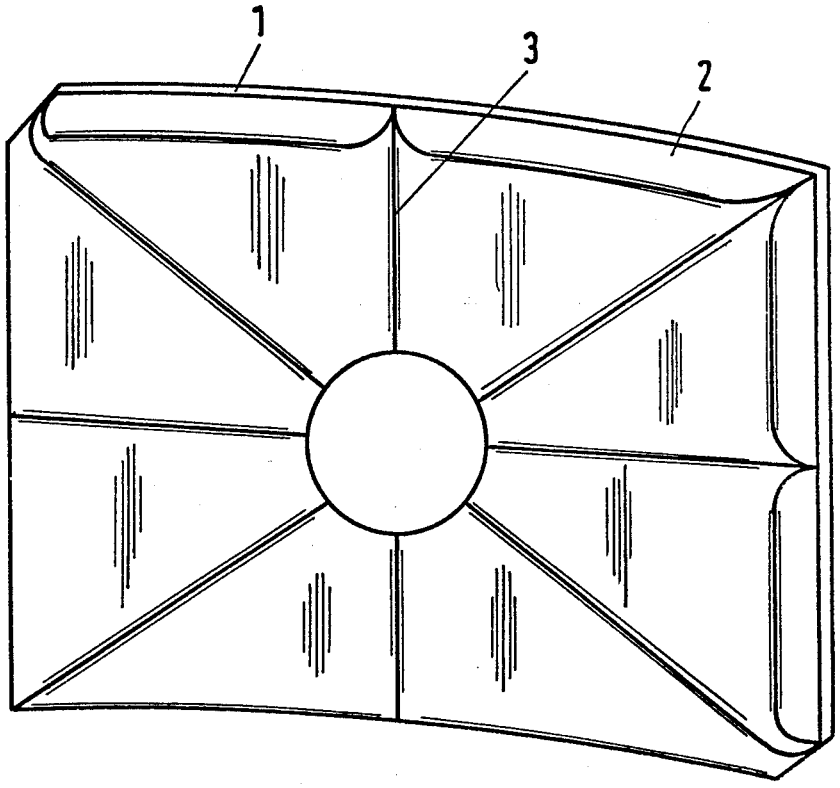

FIG. 1 is a perspective view of a first embodiment of a sound-absorbing panel according to the invention; and FIG. 2 is a view similar to FIG. 1 showing a second embodiment of the invention.

Referring now to the figures of the drawings in detail and first, particularly, to FIG. 1 thereof, there is seen a polyester and preferably non-woven synthetic fiber web 1, onto which a mat 2 of polyurethane foam is welded, sealed or bonded along lines 3, which form a square pattern on the mat 2. This is accomplished by means of a heated welding, sealing or bonding tool according to a heat pulse welding, sealing or bonding method, preferably at 160 degrees to 180 degrees C. A thin film 6 of polyurethane is then sprayed onto the free surface of the polyurethane foam mat 2 so that it becomes water-repellent and no dirt can settle in the pores of the foam. Then the web 1 is formed by thermal deformation into the shape of the area or wall to be protected from the impact of sound waves. Spacers 4, which are disposed at suitable intervals between the sound-absorbing or muffling panel and the area or wall 5, are provided for attachment to this area or wall at a permanent distance of preferably 20 to 30 mm. Depending on the pressure used during the welding together of the web 1 and the mat 2, these two parts are more or less permanently pressed together at the welded spots.

In the embodiment according to FIG. 2, the web 1 and the mat 2 are welded, sealed or bonded together along a pattern of lines extending irregularly from the outer edge of the panel to an inner circle, so that large, irregularly shaped and unconnected pieces remain.

A special field of application for such sound-absorbing panels is the engine compartment of a motor vehicle, the sheet metal walls of which greatly reflect the noise given off by the engine, especially when the sound frequencies lie in the vicinity of the natural frequencies of the sheet metal walls of the engine compartment. The sound-absorbing panel of the invention accomplished a sound damping measured at 99% in the frequency range around 1,000 Hz, with a distance of 20 mm between the sound-absorbing panel and the sheet metal wall of the engine compartment.

If the surface of the sound-absorbing panel is to be not only water-repellent, but water-proof as well, it is recommended to replace the sprayed-on synthetic skin 6 with a nylon web 7 which is spot-welded or line-welded to the synthetic foam mat 2 along lines 3'.

Melamine foam, polyamide foam, glass wool or synthetic wool are especially suitable for this purpose in place of polyurethane foam. Instead of welding the web 1 with the mat 2 along lines 3, spot welding, sealing or bonded is possible, perhaps at the intersecting points of the lines 3, or an attachment of the web and mat by means of rivets or by sew is possible.

The sound-absorbing panel of the invention represents the only known damping system having such high sound-absorbing properties while dispensing with a spatially structured surface, i.e. the damping is accomplished in spite of a smooth surface. Smooth surfaces have the important advantage of preventing dirt from easily adhering to them.

The foregoing is a description corresponding to substance to German application No. G 86 13 009.9, dated May 13, 1986, the International priority of which is being claimed for the instant application, and which is hereby made part of this application. Any material discrepancies between the foregoing specification and the aforementioned corresponding German application are to be resolved in favor of the latter.

We claim:

1. Sound-absorbing panel, comprising a synthetic foam mat having a given size, a synthetic fiber web having substantially said given size, a riveted seam attaching said synthetic foam mat to said synthetic fiber web at least pointwise in a given pattern, and second means for attaching the sound-absorbing panel to a wall for damping sound radiation of the wall while maintaining a distance between the sound-absorbing panel and the wall.

2. Sound-absorbing panel according to claim 1, wherein said second attaching means are in the form of spacers (4).

3. Sound-absorbing panel according to claim 1, wherein said first attaching means attach said synthetic fiber web (1) to said synthetic foam mat (2) along given lines (3) defining substantially uniform areas therebetween.

4. Sound-absorbing panel according to claim 1, wherein said first attaching means attach said synthetic fiber web (1) to said synthetic foam mat (2) along given lines (3) in accordance with a square pattern.

5. Sound-absorbing panel according to claim 1, including a liquid synthetic material (6) sprayed on said synthetic foam mat forming a continuous, water-repellent skin.

6. Sound-absorbing panel according to claim 5, wherein said synthetic skin is a polyurethane skin.

7. Sound-absorbing panel according to claim 1, including a water-proof nylon web (7) covering said synthetic foam mat (2), and third means for connecting said water-proof nylon web to said synthetic foam mat at least pointwise.

8. Sound-absorbing panel according to claim 1, wherein said synthetic foam mat (2) is formed of a material from the group consisting of polyurethane foam, melamine foam and polyamide foam.

9. Sound-absorbing panel according to claim 1, wherein said synthetic foam mat (2) is formed of a material from the group consisting of glass wool and synthetic wool.

10. Sound-absorbing panel according to claim 1, wherein said synthetic fiber web (1) is formed of permanently deformable material.

11. Sound-absorbing panel according to claim 1, wherein said synthetic fiber web (1) is formed of polyester.

12. Sound-absorbing panel according to claim 1, wherein said distance between said synthetic fiber web (1) and the wall is substantially between 20 and 30 mm.

13. Sound-absorbing panel, comprising a synthetic foam mat having a given size, a synthetic fiber web having substantially said given size, a sewn seam attaching said synthetic foam mat to said synthetic fiber web at least pointwise in a given pattern, and second means for attaching the sound-absorbing panel to a wall for damping sound radiation of the wall while maintaining a distance between the sound-absorbing panel and the wall.

14. Sound-absorbing panel, comprising a synthetic foam mat having a given size, a synthetic fiber web having substantially said given size, a welded seam attaching said synthetic foam mat to said synthetic fiber web at least pointwise in a given pattern, and second means for attaching the sound-absorbing panel to a wall for damping sound radiation of the wall while maintaining a distance between the sound-absorbing panel and the wall.

15. Sound-absorbing panel according to claim 13, wherein said first attaching means attach said synthetic fiber web (1) to said synthetic foam mat (2) along given lines (3) defining substantially uniform areas therebetween.

16. Sound-absorbing panel according to claim 14, wherein said first attaching means attach said synthetic fiber web (1) to said synthetic foam mat (2) along given lines (3) defining substantially uniform areas therebetween.

* * * * *

UNITED STATES PATENT OFFICE

CERTIFICATE OF CORRECTION

PATENT NO. 4,805,724

DATED February 21, 1989

INVENTOR(S) Stoll et al

It is certified that error appears in the above-identified patent and that said Letters Patent is hereby corrected as shown below:

In column 3, line 53, "said given size, a riveted seam attaching"
should read
- - said given size, first means in the form of a riveted seam for attaching -- ;

In column 4, line 38, "said given size, a sewn seam attaching"
should read
- - said given size, first means in the form of a sewn seam for attaching - - ;

In column 4, lines 47 and 48, "said given size, a welded seam attaching"
should read
- - said given size, first means in the form of a welded seam for attaching - - .

Signed and Sealed this

Twenty-fifth Day of July, 1989

*Attest:*

*Attesting Officer*

DONALD J. QUIGG

*Commissioner of Patents and Trademarks*